US009272329B2

(12) United States Patent
Radke et al.

(10) Patent No.: US 9,272,329 B2
(45) Date of Patent: Mar. 1, 2016

(54) SAND KNOCK-OUT HEAD CLAMPING ASSEMBLY

(71) Applicant: Honda Motor Co., Ltd., Tokyo (JP)

(72) Inventors: Kristopher Radke, Birmingham, AL (US); Jeffrey S. Havens, Childersburg, AL (US)

(73) Assignee: Honda Motor Co., Ltd., Tokyo (JP)

( * ) Notice: Subject to any disclaimer, the term of this patent is extended or adjusted under 35 U.S.C. 154(b) by 166 days.

(21) Appl. No.: 14/244,989

(22) Filed: Apr. 4, 2014

(65) Prior Publication Data

US 2015/0283608 A1 Oct. 8, 2015

(51) Int. Cl.
*B22D 29/00* (2006.01)
*B22D 29/08* (2006.01)

(52) U.S. Cl.
CPC ..... *B22D 29/005* (2013.01); *B22D 29/00* (2013.01); *B22D 29/08* (2013.01)

(58) Field of Classification Search
CPC ..... B22D 29/00; B22D 29/005; B22D 29/02; B22D 29/08
USPC ..... 164/131, 132, 344–346, 404
See application file for complete search history.

(56) References Cited

U.S. PATENT DOCUMENTS 5,213,150 A * 5/1993 Sensenstein ..... B22D 29/005 164/345
6,644,382 B1 11/2003 Aoyama et al.
2013/0014909 A1* 1/2013 Tomi ..... B22C 11/10 164/4.1

FOREIGN PATENT DOCUMENTS

| | | |
|---|---|---|
| DE | 364225 | 4/1984 |
| DE | 3239262 | 4/1984 |
| EP | 0493999 | 7/1992 |
| GB | 562442 | 7/1944 |
| JP | 07308751 | 11/1995 |
| JP | 08174191 A * | 7/1996 |
| JP | 2010064082 | 3/2010 |

* cited by examiner

*Primary Examiner* — Kevin E Yoon
(74) *Attorney, Agent, or Firm* — Rankin, Hill & Clark LLP

(57) ABSTRACT

A sand knock-out head clamping assembly of a casting vibratory apparatus for engaging a casting to be vibrated is provided. The assembly includes a holder configured to be releasably mounted to a vibratory mechanism of the vibratory apparatus. The holder includes a holder body having a first face in contact with the vibratory mechanism and a second face opposite the first face. The holder body includes an engagement member extending outwardly from the second face. An insert is removably mounted only to the holder. The insert is configured to at least partially receive the engagement member.

20 Claims, 6 Drawing Sheets

SAND KNOCK-OUT HEAD CLAMPING ASSEMBLY

BACKGROUND

A traditional casting process for forming metal castings generally employs a mold or die, such as a permanent, metal die or a sand mold, having the exterior features of a desired casting, such as a cylinder head, formed on its interior surfaces. A sand core comprised of sand and a suitable binder material and defining the interior features of the casting is typically placed within the die to further define the features of the casting. Sand cores generally are used to produce contours and interior features within the metal castings, and the removal and reclaiming of the sand materials of the cores from the castings after the casting process is completed is a necessity.

The sand molds and/or cores are removed from the respective castings prior to completion of heat treatment and are typically separated from their castings by one or a combination of methods. For example, sand may be chiseled away from the casting or the casting may be physically shaken or vibrated to break-up the sand molds and internal sand cores within the castings to remove the sand. Regarding the latter method, separation of the sand is commonly carried out through a vibratory apparatus which subjects the casting to a hammering so as to detach the sand cores, then to vibrations so as to disintegrate the sand cores and discharge the fragments of the cores by the effect of gravity. The vibratory apparatus typically includes a pad to hold pressure against the casting as pneumatic hammers pound on the casting. The known pad is fully machined, and both sides of the pad are used for processing of the castings. However, upon wear, the pad is typically discarded which increases the costs associated with the casting process.

BRIEF DESCRIPTION

In accordance with one aspect, a sand knock-out head clamping assembly of an associated casting vibratory apparatus for engaging an associated casting to be vibrated is provided. The assembly comprises a holder configured to be releasably mounted to an associated vibratory mechanism of the associated vibratory apparatus. The holder includes a body having a first face in contact with the associated vibratory mechanism and a second face opposite the first face. The holder body includes an engagement member extending outwardly from the second face. An insert is removably mounted only to the holder. The insert is configured to at least partially receive the engagement member.

In accordance with another aspect, a sand knock-out head clamping assembly of an associated casting vibratory apparatus for engaging an associated casting to be vibrated comprises a holder and an insert removably mounted only to the holder. The holder includes a holder body having a plurality of mounting holes extending therethrough. The mounting holes are dimensioned to receive associated fasteners which fasten the holder to an associated vibrating mechanism of the associated vibratory apparatus. The holder body includes a first sidewall and a second sidewall opposite the first sidewall. A first flange structure is provided adjacent the first sidewall and a second flange structure is provided adjacent the second side wall. The insert is dimensioned to be slidingly received between the first and second flange structures. The insert includes an insert body having a first side configured to at least partially receive one of the first flange structure and second flange structure and a second side configured to at least partially receive the other of the first flange structure and the second flange structure.

In accordance with yet another aspect, a vibrating apparatus for vibrating an associated casting mounted thereto during a casting process comprises a frame and a vibrating mechanism mounted to the frame. The vibrating mechanism is operable to vibrate the associated casting. A sand knock-out head clamping assembly is mounted to the vibrating mechanism. The assembly includes a holder including a holder body having a plurality of mounting holes extending therethrough. The mounting holes are dimensioned to receive fasteners which fasten the holder to the vibrating mechanism. The holder body includes a first sidewall and a second sidewall opposite the first sidewall. A first flange structure and a second flange structure spaced from the first flange structure extend outwardly from the body opposite the connection of the body to the vibrating mechanism. An insert is removably mounted to the holder. The insert includes an insert body having a first side and a second side opposite the first side. A first elongated channel is provided on the first side for at least partially receiving one of the first flange structure and second flange structure. A second elongated channel is provided on the second side for at least partially receiving the other of the first flange structure and the second flange structure. A retainer engages both a top wall of the holder body and a top wall of the insert body. The insert is configured such that the fasteners do not directly engage the insert body. The insert has a first mounting position on the holder where a first surface of the insert body engages the associated casting and a second mounting position on the holder where a second surface of the insert body engages the associated casting.

DETAILED DESCRIPTION

It should, of course, be understood that the description and drawings herein are merely illustrative and that various modifications and changes can be made in the structures disclosed without departing from the present disclosure. In general, the figures of the exemplary sand knock-out head clamping assembly are not to scale. It will also be appreciated that the various identified components of the exemplary sand knock-out head clamping assembly disclosed herein are merely terms of art that may vary from one manufacturer to another and should not be deemed to limit the present disclosure.

Figure 1:
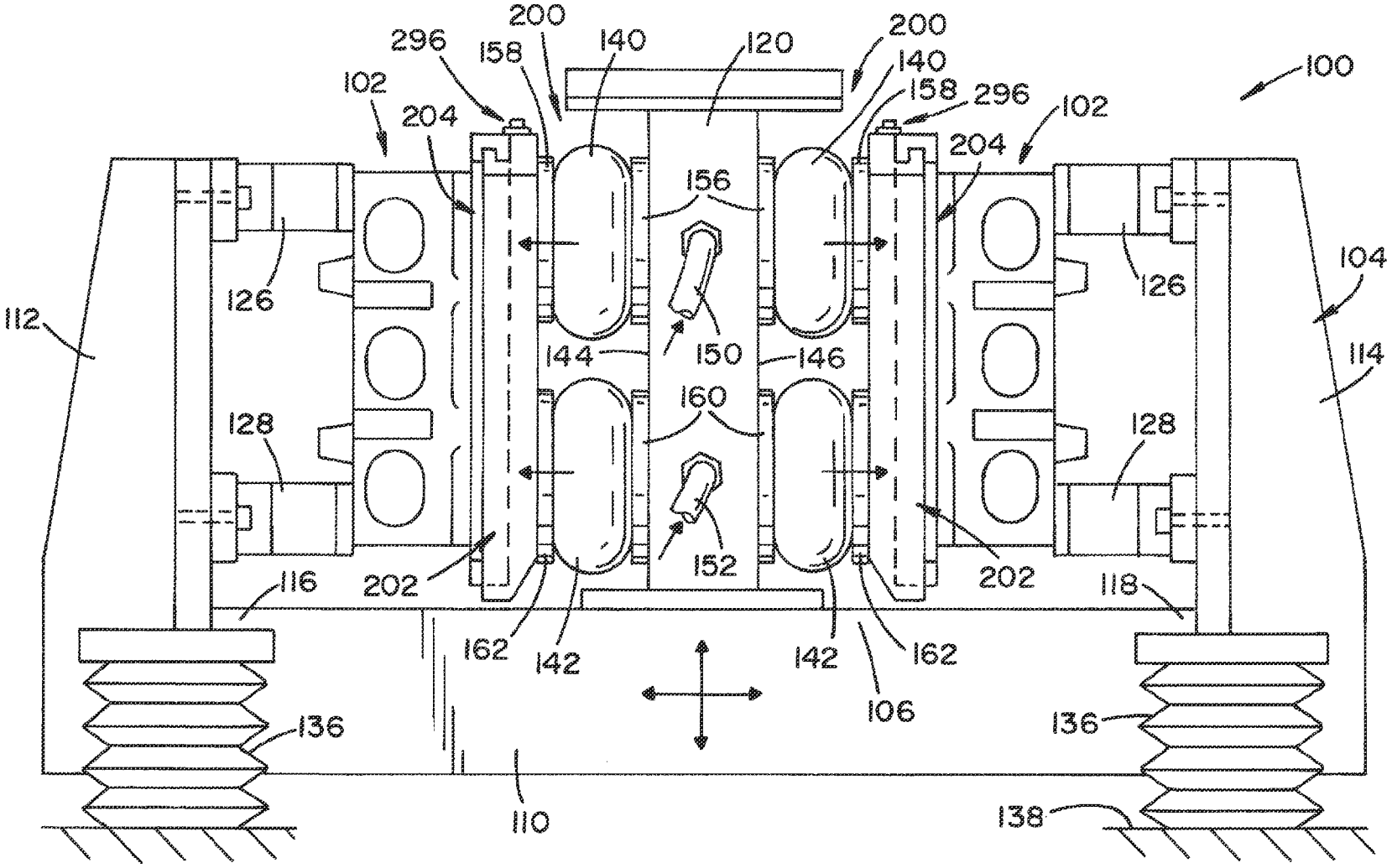
FIG. 1 is a front view of a vibrating apparatus including a pair of exemplary sand knock-out head clamping assemblies, each assembly engaging a casting to be vibrated.
Figure 2:
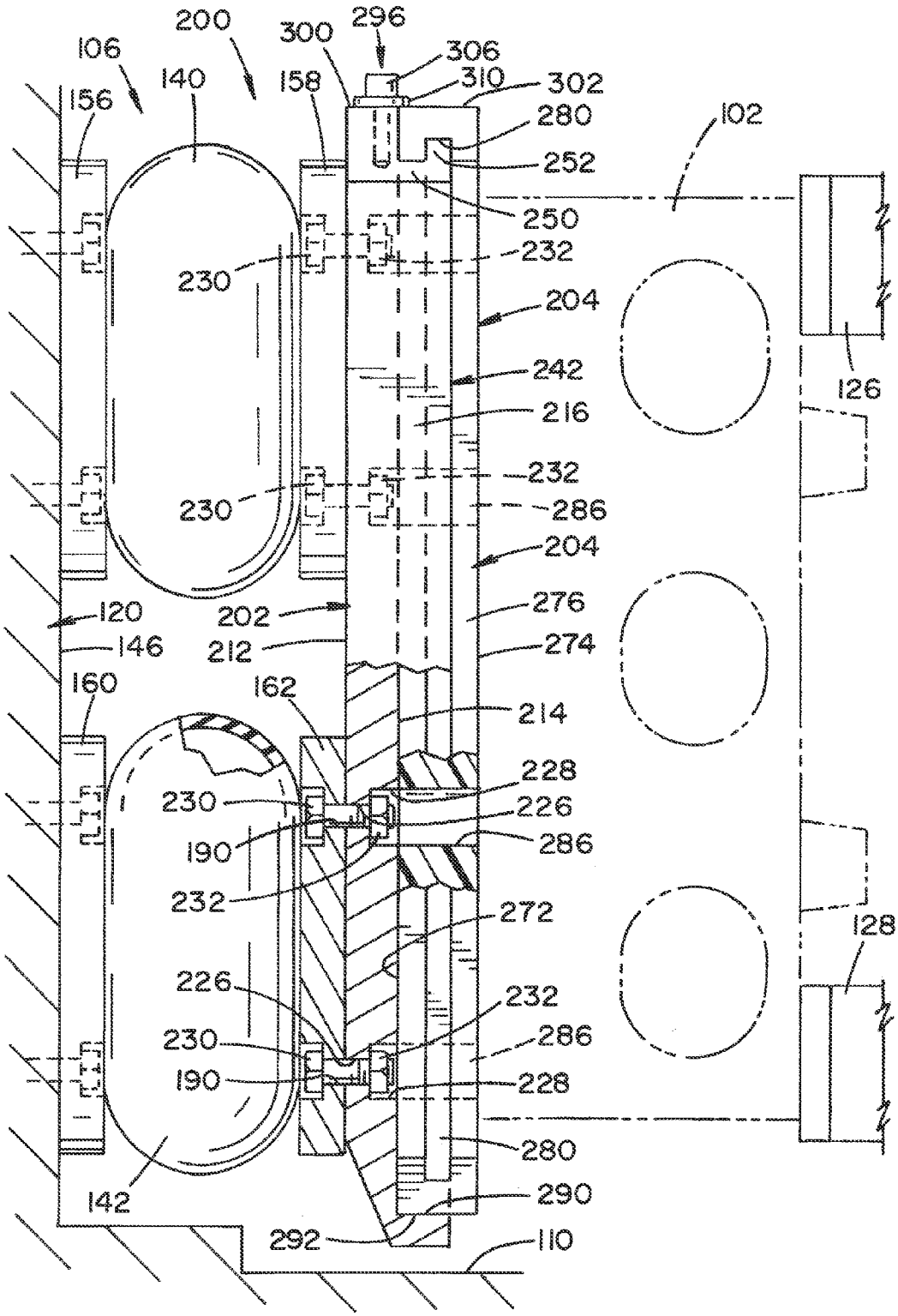
FIG. 2 is a partial cross-sectional view of one of the sand knock-out head clamping assemblies of FIG. 1.

Referring now to the drawings, wherein like numerals refer to like parts throughout the several views, FIG. 1 illustrates a vibrating apparatus 100 for vibrating at least one casting 102, such as the depicted cylinder heads for V-6 engine blocks, mounted thereto during a casting process. The vibrating apparatus 100 includes a frame 104 and a vibrating mechanism 106 mounted to the frame 104 and operable to vibrate the casting. The frame 104 can include a base member 110, a pair of uprights or vertical supports 112, 114 secured to opposed end portions 116, 118 of the base member 110, and a central upright or support 120. Attached to each support 112, 114 is a pair of spaced clamping members 126, 128 configured to engage the casting 102. Each clamping member 126, 128 can be selectively vertically positioned on their respective support 112, 114 which allows for different sized castings 102 to be mounted to the vibrating apparatus 100. The vibrating mechanism 106 may be realized by various forms, and in the depicted apparatus 100, includes plate springs 136 mounted at the end portions 116, 118 of the base member 110, the plate springs 136 elevating the frame 104 from a supporting surface 138. A vibrating device (not shown) is operably connected to the base member 110 and actuation of the vibrating device imparts vibrations to the base member. The vibrating mechanism 106 further includes a pair of pneumatic hammers or bellows 140, 142 mounted to opposite sides 144, 146 of the central support 120. The bellows 140, 142 are selectively expandable by way of pressurized air flowing into the central support 120 via air lines 150, 152. As shown, each bellow 140 is sandwiched between support plates 156, 158, with support plates 156 being fastened to the central support. Similarly, each bellow 142 is sandwiched between support plates 160, 162, with support plate 160 being fastened to the central support 120.

Figure 6:
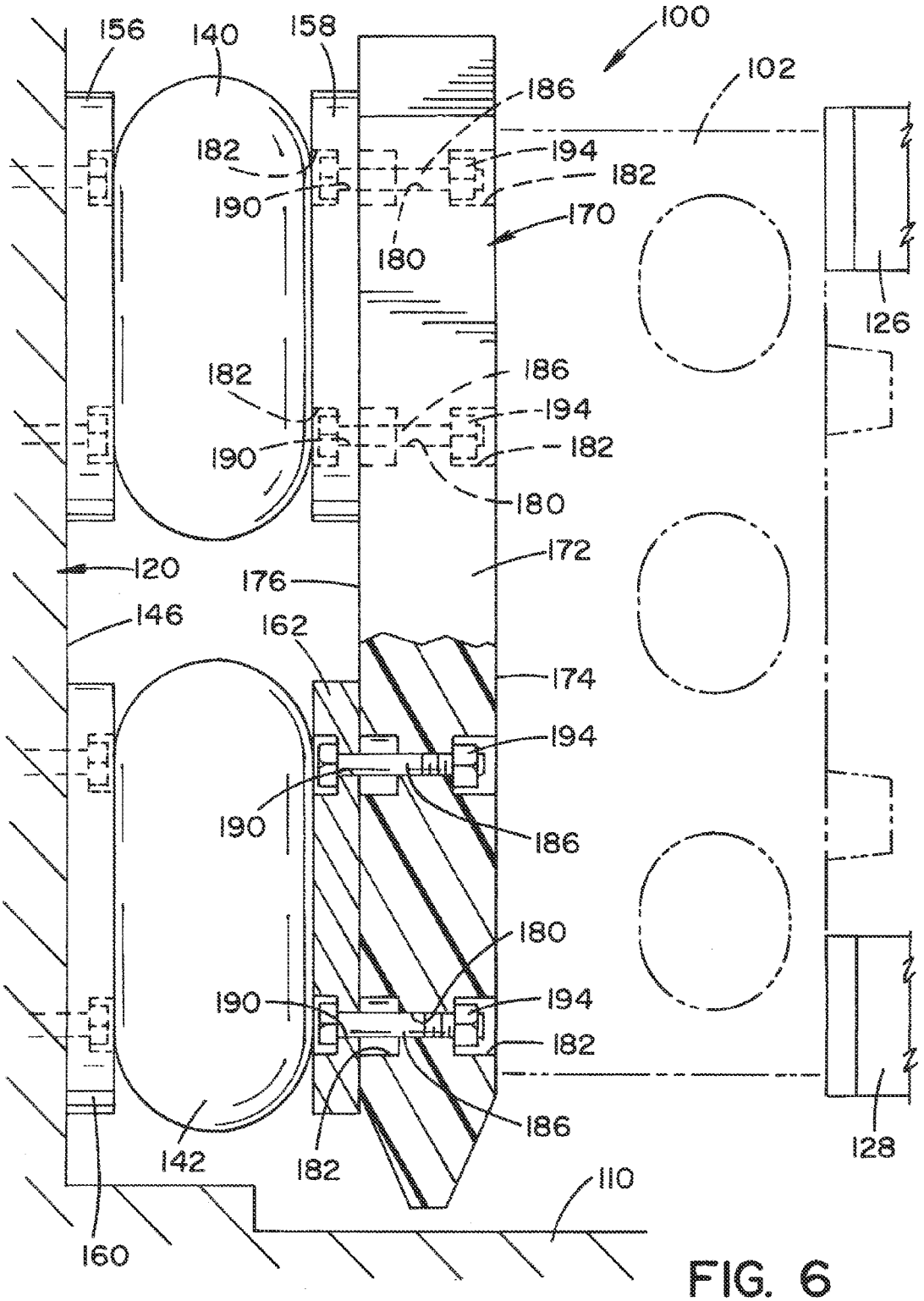
FIG. 6 (PRIOR ART)
FIG. 6 is a partial cross-sectional view of the vibrating apparatus of FIG. 1 with a known pad for engaging the casting to be vibrated.

FIG. 6 depicts the vibrating apparatus 100 with a known pad 170 interposed between the casting 102 and the support plates 158, 162 for holding pressure against the casting 102 as the vibrating mechanism 106 shakes the casting 102 to remove sand remained in the casting process. The pad 170 includes a body 172 having a first surface 174 and a second surface 176 opposite the first surface. The first surface 174 is in direct contact with the casting 102. The second surface 176 is in direct contact with the support plates 158, 162. A plurality of mounting holes 180 extend through the body 172 of the pad 170. Each of the mounting holes 180 is provided with a counterbore 182 located on each of the first and second surfaces 174, 176. The pad 170 is attached to the support plates 156, 162 by fasteners 186, such as the depicted bolts, which extend through corresponding mounting holes 190 provided on the supports 158, 162 and the mounting holes 180 of the pad 170. An end of each fastener 186 is secured to a nut 194 located in the counterbore 182, which ensures that the casting 102 is not damaged by the nuts during operation of the vibrating apparatus 100. However, with this known mounting arrangement, each of the first and second surfaces 174, 176 of the pad 170 can become damaged and/or worn during shaking of the casting 102 by the vibrating mechanism 106. Depending on the amount of damage and/or wear to the second surface 176, the pad 170 cannot be turned and must be discarded.

With reference to FIGS. 2-5, the present disclosure is directed to a sand knock-out head clamping assembly 200 to be used with the vibrating apparatus 100 for engaging the casting 102 instead of the known pad 170. The assembly 200 comprises a holder 202 configured to be releasably mounted to the associated vibratory mechanism 106 and an insert or pad 204 removably mounted only to the holder 202. The holder 202 can be formed from aluminum/aluminum alloy and the insert 204 can be formed from a nylon material. In the depicted embodiment, the holder 202 includes a body 210 having a first face 212 and a second face 214 opposite the first face. The body 210 further includes a first sidewall 216 and a second sidewall 218 opposite the first sidewall, the first and second sidewalls extending along a length of the body 210. As shown, the first face 212 of each holder 210 mounted to the vibrating apparatus 100 is in contact with the vibratory mechanism 106, and particularly, is in direct contact with the support plates 158, 160. To mount the holder 202 to the support plates 158, 160 on either side 144, 146 of the central upright 120, the holder body 210 includes a plurality of mounting holes 226 extending therethrough. Each of the mounting holes 226 is provided with a counterbore 228 located on the second face 214. The mounting holes 226 are dimensioned to receive fasteners 230, such as the depicted bolts, which fasten the holder to the support plates 158, 160 of the vibrating mechanism 106. The fasteners 230 extend through the mounting holes 190 provided on the support plates 158, 162 and the mounting holes 226 of the holder 202. An end of each fastener 230 is secured to a nut 232 located in the counterbore 228, which ensures that the insert 204 is not damaged by the fasteners and/or nuts during operation of the vibrating apparatus 100. However, it should be appreciated that the fasteners may be any type of mechanical fastening devices commonly known in the art so long as an end of the fastener does not engage the insert 204.

Figure 3:
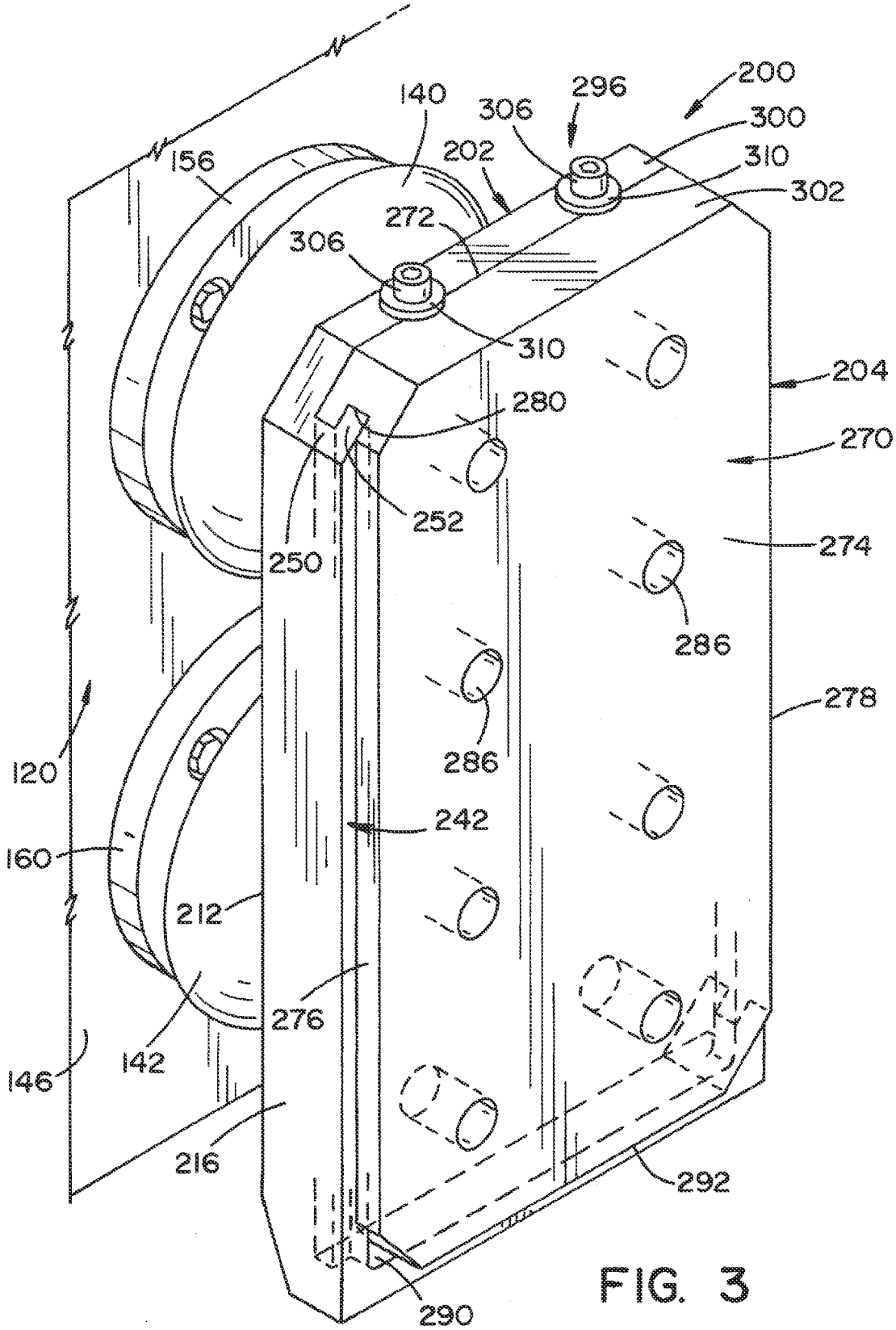
FIG. 3 is a perspective view of one of the sand knock-out head clamping assemblies of FIG. 1.
Figure 4:
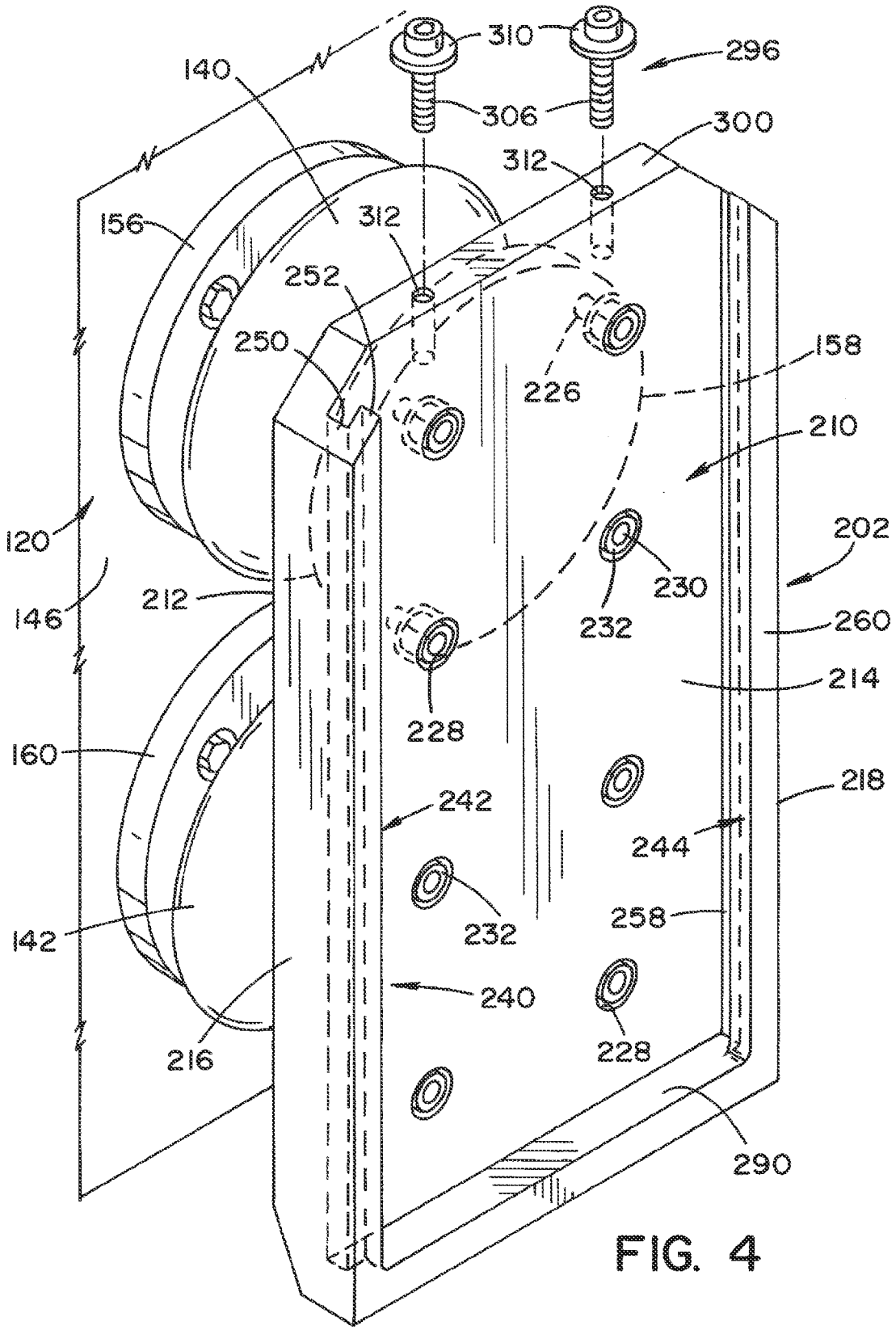
FIG. 4 is a partial exploded view of the assembly of FIG. 3.

As best depicted in FIGS. 3 and 4, the holder body 210 includes an engagement member 240 extending outwardly from the second face 214 opposite the connection of the holder body 210 to the vibrating mechanism 106. The insert 204 is configured to at least partially receive the engagement member 240. In the illustrated embodiment, the engagement member 240 can include a first flange structure 242 located adjacent the first sidewall 216 of the holder body 210. The first flange structure 242 can extend approximately an entire length of the first sidewall 216 and includes a first section 250 extending perpendicularly from the second face 214 of the holder body 210 and a second section 252 extending perpendicularly from the first section 250. The engagement member 240 can also include a second flange structure 244 located adjacent the second sidewall 218 of the holder body 210. Similar to the first flange structure, the second flange structure 244 can extend approximately an entire length of the second sidewall 218 of the holder body 210 and includes a first section 258 extending perpendicularly from the second face 214 of the holder body 210 and a second section 260 extending perpendicularly from the first section 258. According to one aspect, the first flange structure 242 is L-shaped, and the second section 252 extends toward the second sidewall 218 of the holder body 210. The second flange structure 244 is also L-shaped, and the second section 260 extends toward the first sidewall 216 of the holder body 210. However, it should be appreciated that alternative configurations for the first and second flange structures 242, 244 are contemplated. By way of example, each of the first and second flange structures can include a single section extending outwardly from the second face 214 and canted toward the other flange structure.

Figure 5:
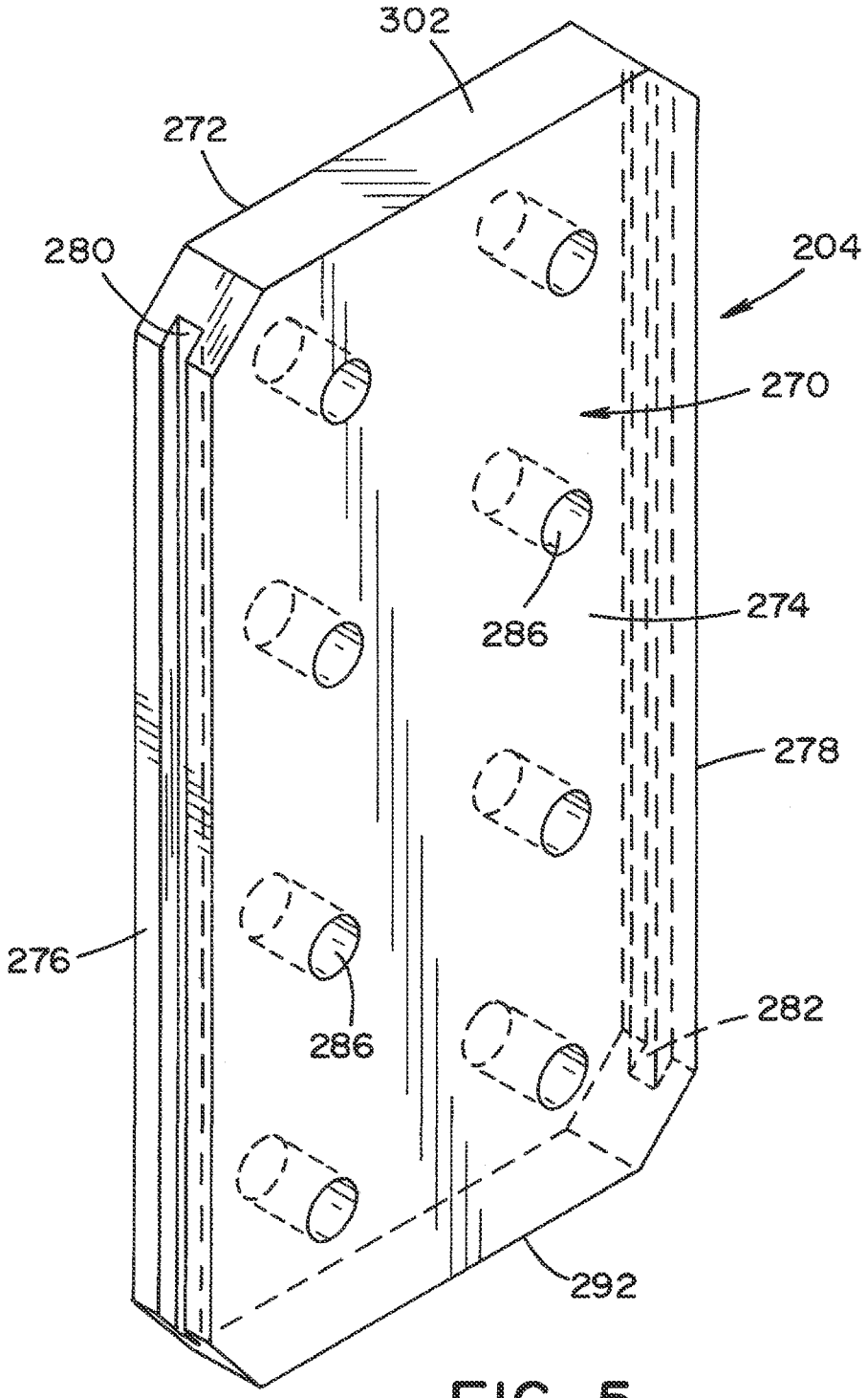
FIG. 5 is a perspective view of an exemplary insert of the assembly of FIG. 3.

The insert 204 is removably mounted only to the holder 202 and is dimensioned to be slidingly received between the first and second flange structures 242, 244. With reference to FIG. 5, the insert 204 includes an insert body 270 having a first surface 272 and a second surface 274 opposite the first surface, and one of the first and second surfaces 272, 274 directly contacts or engages the casting 102. The insert body 270 further includes a first side 276 and a second side 278 opposite the first side, each side being configured to engage the first and second flange structures 242, 244 of the holder 202. According to one aspect, the first side 276 is configured to at least partially receive one of the first and second flange structures 242, 244 of the holder 202 and the second side 278 is configured to receive the other of the first and second flange structures 242, 244. In the depicted embodiment, the first side 276 of the insert body 270 includes an elongated channel 280 extending approximately an entire length of the first side, and the second side 278 of the insert body includes a second elongated channel 282 extending approximately an entire length of the second side. Each of the channels 280, 282 can be centered with respect to the first and second sides 276, 278 and is dimensioned to at least partially receive one of the first and second flange structures 242, 244 of the holder body 210. Particularly, each of the channels 280, 282 is dimensioned to slidingly receive the second section 252 of the first flange structure 242. Each of the channels 280, 282 is also dimensioned to slidingly receive the second section 260 of the second flange structure 244. This allows the insert 204 to be flipped and/or rotated in the holder 202 upon wear of one of the first and second surface 272, 274. Therefore, the insert 204 is configured to have a first mounting position on the holder 202 where the first surface 272 engages the casting 102 and a second mounting position on the holder 202 where the second surface 274 engages the casting. The insert body 270 can also include a plurality of apertures 286 extending therethrough. Once inserted into the holder 202, the apertures 286 of the insert 204 are aligned with the plurality of mounting holes 226 of the holder body 210, and the apertures 286 allow for inspecting of the fasteners 230. However, to ensure that both surfaces 272, 274 of the insert body 270 can be used to directly contact or engage the casting 102 before the insert 204 has to be discarded due to wear, the holder 202 and insert 204 are configured such that the fasteners 230 do not directly contact or engage the insert.

With reference back to FIGS. 3 and 4, the holder 202 includes a lower shelf 290 for supporting one of a bottom wall 292 or a top wall 302 of the insert body 270. Further, the insert body 270 can include chamfered corners; although, this is not required. Further, to maintain the insert 204 in the holder 202, a retainer 296 is provided for engaging both a top wall 300 of the holder body 210 and the top wall 302 of the insert body 270. In the depicted embodiment, the retainer 296 is mounted only to the top wall 300 of the holder body 210 and can include a pair of fasteners 306 which extend through washers 310 and threadingly engage holes 312 provided on the top wall 300. Once positioned in the holes 312, at least one of the heads of the fasteners 306 or washers 310 directly engages the top wall 302 of the insert 204. In contrast to the plurality of fasteners 186 for mounting the known pad 170 to the vibrating mechanism 106 and replacing the pad 170 after wear, the present assembly 200 is only provided with the retainer 296 which allows for ease of insert 204 removal and/or replacement from the holder 202.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A sand knock-out head clamping assembly of an associated casting vibratory apparatus for engaging an associated casting to be vibrated, the assembly comprising:

a holder configured to be releasably mounted to an associated vibratory mechanism of the associated vibratory apparatus, the holder including a holder body having a first face in contact with the associated vibratory mechanism and a second face opposite the first face, the holder body including an engagement member extending outwardly from the second face; and an insert removably mounted only to the holder, the insert being configured to at least partially receive the engagement member.

2. The assembly of claim 1, wherein the insert includes an insert body having a first surface and a second surface opposite the first surface, one of the first and second surfaces directly engaging the associated casting.

3. The assembly of claim 2, wherein the insert is configured to have a first mounting position on the holder where the first surface engages the associated casting and a second mounting position on the holder where the second surface engages the associated casting.

4. The assembly of claim 1, wherein the holder body includes a first sidewall and a second sidewall opposite the first sidewall, the first and second sidewalls extending along a length of the holder body, and the engagement member includes a first flange structure located adjacent the first sidewall and a second flange structure located adjacent the second sidewall.

5. The assembly of claim 4, wherein the first flange structure extends approximately an entire length of the first sidewall of the holder body, the first flange structure including a first section extending perpendicularly from the second face of the holder body and a second section extending perpendicularly from the first section.

6. The assembly of claim 5, wherein the first flange structure is L-shaped, the second section extending toward the second sidewall of the holder body.

7. The assembly of claim 5, wherein the insert includes an insert body having a first side and a second side opposite the first side, the first side of the insert body including an elongated channel dimensioned to slidingly receive the second section of the first flange structure, the second side of the insert body engaging the second flange structure.

8. The assembly of claim 5, wherein the second flange structure extends approximately an entire length of the second sidewall of the holder body, the second flange structure including a first section extending perpendicularly from the second face of the holder body and a second section extending perpendicularly from the first section.

9. The assembly of claim 8, wherein the second flange structure is L-shaped, the second section extending toward the first sidewall of the holder body.

10. The assembly of claim 8, wherein the insert includes an insert body having a first side and a second side opposite the first side, the first side of the insert body including a first elongated channel dimensioned to slidingly receive one of the second section of the first flange structure and the second section of the second flange structure, the second side of the insert body including a second elongated channel dimensioned to slidingly receive the other of the second section of the first flange structure and the second section of the second flange structure.

11. The assembly of claim 1, wherein the holder body includes a plurality of mounting holes extending therethrough, the mounting holes dimensioned to receive associated fasteners which fasten the holder to the associated vibrating mechanism, and the insert including a plurality of apertures aligned with the plurality of mounting holes, the apertures allowing for inspecting of the associated fasteners.

12. The assembly of claim 11, wherein the insert is configured such that the associated fasteners do not directly contact the insert.

13. The assembly of claim 1, wherein the holder body includes a top wall having a retainer mounted thereto, the retainer engaging a top wall of the insert to maintain the insert in the holder.

14. A sand knock-out head clamping assembly of an associated casting vibratory apparatus for engaging an associated casting to be vibrated, the assembly comprising:

a holder including a holder body having a plurality of mounting holes extending therethrough, the mounting holes dimensioned to receive associated fasteners which fasten the holder to an associated vibrating mechanism of the associated vibratory apparatus, the holder body including a first sidewall and a second sidewall opposite the first sidewall, a first flange structure is provided adjacent the first sidewall and a second flange structure is provided adjacent the second side wall; and an insert removably mounted only to the holder and dimensioned to be slidingly received between the first and second flange structures, the insert including an insert body having a first side configured to at least partially receive one of the first flange structure and second flange structure and a second side configured to at least partially receive the other of the first flange structure and the second flange structure.

15. The assembly of claim 14, wherein each of the first and second sides of the insert body includes an elongated channel dimensioned to at least partially receive one of the first and second flange structures of the holder body.

16. The assembly of claim 15, wherein each of the first and second flange structures is L-shaped.

17. The assembly of claim 14, wherein the insert body includes a first surface and a second surface opposite the first surface, the insert configured to have a first mounting position on the holder where the first surface directly contacts the associated casting and a second mounting position on the holder where the second surface directly contacts the associated casting.

18. The assembly of claim 14, wherein the holder body includes a top wall having at least one retainer mounted thereto, the at least one retainer directly engaging a top wall of the insert.

19. A vibrating apparatus for vibrating an associated casting mounted thereto during a casting process, the vibrating apparatus comprising:

a frame;

a vibrating mechanism mounted to the frame and operable to vibrate the associated casting; and a sand knock-out head clamping assembly mounted to the vibrating mechanism, the assembly including:

a holder including a holder body having a plurality of mounting holes extending therethrough, the mounting holes dimensioned to receive fasteners which fasten the holder to the vibrating mechanism, the holder body including a first sidewall and a second sidewall opposite the first sidewall, a first flange structure and a second flange structure spaced from the first flange structure extend outwardly from the holder body opposite the connection of the body to the vibrating mechanism, an insert removably mounted to the holder, the insert including an insert body having a first side and a second side opposite the first side, a first elongated channel provided on the first side for at least partially receiving one of the first flange structure and second flange structure, a second elongated channel provided on the second side for at least partially receiving the other of the first flange structure and the second flange structure, and a retainer for engaging both a top wall of the holder body and a top wall of the insert body, wherein the insert is configured such that the fasteners do not directly engage the insert body, and wherein the insert has a first mounting position on the holder where a first surface of the insert body engages the associated casting and a second mounting position on the holder where a second surface of the insert body engages the associated casting.

20. The apparatus of claim 19, wherein the insert body includes a plurality of apertures aligned with the mounting holes, the apertures allowing for inspecting of the fasteners.

* * * * *